US009545167B2

(12) United States Patent
Honeycutt

(10) Patent No.: US 9,545,167 B2
(45) Date of Patent: Jan. 17, 2017

(54) FOOD PRODUCT STABILIZATION SYSTEMS

(71) Applicant: Barbi Honeycutt, Willow Springs, NC (US)

(72) Inventor: Barbi Honeycutt, Willow Springs, NC (US)

( * ) Notice: Subject to any disclaimer, the term of this patent is extended or adjusted under 35 U.S.C. 154(b) by 170 days.

(21) Appl. No.: 14/164,164

(22) Filed: Jan. 25, 2014

(65) Prior Publication Data

US 2015/0208840 A1 Jul. 30, 2015

(51) Int. Cl.
*A47G 19/30* (2006.01)
*A47G 19/26* (2006.01)

(52) U.S. Cl.
CPC ..... *A47G 19/30* (2013.01); *A47G 19/265* (2013.01)

(58) Field of Classification Search
CPC ..... A47G 19/265; A47G 21/045
USPC ... 294/7; 30/122, 124, 303; 99/645; 206/551
See application file for complete search history.

(56) References Cited

U.S. PATENT DOCUMENTS 2,573,577 A * 10/1951 Koponen ..... A47G 19/265 294/173
2,617,350 A * 11/1952 Shol ..... A47G 19/265 220/529
2,637,617 A 5/1953 Stotter
2,716,066 A * 8/1955 Baker ..... A47G 19/265 426/132
3,677,168 A * 7/1972 Bell ..... A47G 19/265 426/128
4,114,265 A 9/1978 Bailey
4,359,156 A * 11/1982 Austin ..... B65G 15/60 198/823
D290,232 S * 6/1987 Holzkopf ..... D9/424
4,947,993 A * 8/1990 Bruml ..... A47G 19/26 206/551
5,129,159 A 7/1992 Fuenzalida
5,446,965 A 9/1995 Makridis
7,044,518 B2 * 5/2006 Lang ..... A47G 21/045 294/7
7,480,999 B2 1/2009 Atwater et al.
2013/0019726 A1 1/2013 Rosenbaum

*Primary Examiner* — Sarah McPartlin
(74) *Attorney, Agent, or Firm* — Garrett James O'Sullivan; Eric Brandon Lovell

(57) ABSTRACT

Food product stabilization systems employing features to stabilize upright food wares that are subject to tipping, crumbling and/or being damaged during transport or storage. Freestanding upright food wares may have exposed edges requiring some form of protection to reduce and/or prevent unwanted surface deterioration, crumbling, tilting, sliding, collapsing and/or damage resulting from transportation and/or storage. Varieties of food containers are disposed around upright food wares as a general means of protecting against humidity, oxidation and/or contaminates from an outside environment. In cases where upright food wares are dissimilarly shaped or sized disproportionately to food containers, unwanted surface deterioration, crumbling, sliding, spillage or damage may occur. The food product stabilization system comprises proportionately designed shapes and/or extendable/contractible edge support features to better enable the upright food wares to be protected, braced, and held more securely during transportation and/or storage. In this manner upright food wares may be efficiently contained, transported or stored even while subjected to external conditions that might otherwise cause damage.

9 Claims, 9 Drawing Sheets

FOOD PRODUCT STABILIZATION SYSTEMS

FIELD OF DISCLOSURE

The field of the disclosure relates to food storage and transportation products to provide protection, including but not limited to upright food wares such as cakes, breads, pastries, casseroles, etc. As a non-limiting example, food storage, protection and transportation products may be used with dessert items such as freestanding layer cakes.

BACKGROUND

Traditional food product container systems are primarily intended to provide storage and/or means of transportation for various food wares, to divide food wares into equal portions, and/or to provide protection for exposed edges of food products. Lacking from prior-art food product storage, stabilization and/or transportation devices is the capability to make easily customizable adjustments that continuously conform to the diverse geometry of food wares throughout the various instances of consumption. As a non-limiting example, a whole cake can be easily transported via prior-art container devices but ensuing consumption may lead to the need for transporting smaller portions of the cake that are far less stable, which may cause unwanted tipping, crumbling, collapsing, and/or shifting that damages the food products during transportation or storage. Furthermore, prior-art food container systems are principally designed around a whole food product, which can create wasted storage space as food wares are gradually consumed and the larger containers are utilized to store smaller and smaller fractions of partly consumed food wares. Another disadvantage of prior-art food product container systems is the inability to reposition more delicate food wares from one food storage device to another without causing undesirable damage such as tipping, crumbling and/or collapsing. What is needed is an efficient food product stabilization systems employing proportionately designed shapes and expandable/contractible support features to protect, brace, store, transport and continuously maintain various geometry of upright food wares.

SUMMARY OF THE DETAILED DESCRIPTION

Embodiments disclosed herein include food product stabilization and transport systems employing proportionately designed shapes and expandable/contractible support features to protect, brace, store and transport upright food wares, and related components and methods. Upright food products such as cakes, breads, pastries, casseroles etc. frequently require both protection from the outside environment, for normal food preservation, and means of storage and/or transportation wherein upright food wares are moved from one location to another. In cases where upright food wares are moved, even in instances of moving a short distance, unwanted tipping, crumbling, collapsing, falling and/or shifting may occur, which may damage various food products. In cases where partly consumed and/or smaller portions of food wares are stored in larger containers intended for larger food products, such as a whole cake, wasted space becomes a frequent problem when storing smaller fractional portions of food wares. The food product stabilization, storage and transport systems features proportionately designed shapes and expandable/contractible support features enabling customizable compartments and/or supports. In this manner, upright food wares can be efficiently protected, braced, stored and/or transported more securely thus preventing unwanted damage to food products.

In this regard, in one embodiment, a food product stabilization system for protecting different varieties of food wares is disclosed. The food product stabilization system comprises an at least one "L" shaped restraint article upon which upright food products are disposed in an abutting horizontal and vertical relationship wherein a first horizontal base surface of the at least one "L" shaped restraint article extends to a second vertical side portion providing stability for any upright food wares. The food product stabilization system may further comprise at least one integrated back-support element and/or at least one panel stiffening facet for additional rigidity and upright stability. The food product stabilization system may still further comprise alternatively designed edge geometry intended to coincide with diverse perimeter geometry of upright food wares. In this manner, upright food wares can be securely held in abutting juxtaposition with the at least one "L" shaped restraint article and thus be efficiently stabilized and/or transported.

In another embodiment, a food product stabilization system for protecting different varieties of food wares is disclosed. The food product stabilization system comprises an at least one "L" shaped restraint article featuring a vertical axis cylinder around which an at least one vertical upright separating hinge may pivot and lock into specific positions thereby creating customizable divided sections into which upright food products are disposed in an abutting horizontal relationship with the base portion of the restraint article and further disposed in two abutting vertical relationships, the first being the side portion of the "L" shaped restraint article and the second being the vertical edges of the separating hinge. In this manner, customized shapes are easily created by means of a pivoting and lockable separator hinge that provides additional support and conforms to the various geometries of food products and/or during different stages consumption.

In another embodiment, a food product stabilization system for protecting different varieties of food wares is disclosed. The food product stabilization system comprises an at least one "L" shaped restraint article featuring a plurality of both vertical and horizontal guides and/or slots into which at least one vertical divider panels may be positioned to create multiple customizable compartments to hold various types and/or sizes of food wares. The food product stabilization system may further comprise at least one integrated back-support element designed to pivot upon a vertical hinge axis so that the back-support element may be collapsed into a space-saving position for storage or pivoted into a generally perpendicular relationship to the vertical side of the "L" shaped restraint article and thereby provide additional vertical support and further prevent any unwanted tipping or spillage during storage or transport of the upright food products.

In another embodiment, a food product stabilization system for protecting different varieties of food wares is disclosed. The food product stabilization system comprises an at least one "L" shaped restraint article featuring a common vertical axis cylinder around which multiple vertically upright separating hinges may each freely pivot and lock into specific positions thereby creating a plurality of customizable divided sections into which many different fractional sizes of upright food products may be disposed in both an abutting horizontal relationship with the base portion of the restraint article and further disposed upon multiple abutting vertical relationships with either the side portion of the "L" shaped restraint article, or the multiple side edges of the plurality of the vertical separating hinges, or both. In this manner, a plurality of customizable and angled compartments are easily created by means of multiple pivoting and lockable separator hinges that each provide additional support and further conform to the various sizes and geometries of food products and/or during the various stages food consumption.

In another embodiment, a food product stabilization system for protecting different varieties of food wares is disclosed. The food product stabilization system comprises an at least one "L" shaped restraint article featuring a vertical axis cylinder around which an at least one vertical upright separating hinge may pivot and lock into specific positions thereby creating customizable divided sections into which upright food products are disposed in an abutting horizontal relationship with the base portion of the restraint article and further disposed in two abutting vertical relationships, the first being the side portion of the "L" shaped restraint article and the second being the vertical edges of the separating hinge. The food product stabilization system further comprises at least one adjustable height panel to further customize and adjust the upright vertical support-panel geometry for taller or shorter food products and thereby creating added vertical stability for a diverse assortment of differently sized upright food products.

In another embodiment, a food product stabilization system for protecting different varieties of food wares is disclosed. The food product stabilization system comprises any variety of the aforementioned "L" shaped restraint articles and/or dividing panels and/or hinges and further comprises a horizontal foundational base platform onto which any of the food product stabilization system embodiments may be secured into place. The food product stabilization system further comprises a top-cover, which can be locked securely onto the horizontal base platform and thereby contain the food product stabilization system(s). In this manner, a more complete food product stabilization and protection and/or storage system is created to further protect and preserve food wares.

In still another embodiment, a food product stabilization system for protecting different varieties of food wares is disclosed. The food product stabilization system comprises any type of the abovementioned "L" shaped restraint articles, dividing panels and/or hinges and further comprises a carrying apparatus that is designed to fit securely onto food product container elements such as a horizontal foundational base platform and/or a vertical top-cover. In this manner, considerably more complete food product stabilization, protection, storage and transportation systems are duly created to efficiently protect, store, brace, preserve and transport any variety of food wares in a secure manner and thus prevent unwanted damage to any assortment or size of upright food products.

In another embodiment, the food product stabilization system may be readily contained within traditional storage containers and/or utilized to more easily move and transfer different varieties of food wares from any of the food product stabilization system storage containers to any additional variety of traditional food product containers without causing undesirable damage such as tipping, crumbling and/or collapsing. In this manner, a more efficient method is created to transfer and/or relocate food products from one storage device to another and thus prevent unwanted damage to upright food wares.

Additional advantages and features will be set forth in the detailed description that follows, and in part will be readily apparent to those skilled in the art from the descriptions and/or recognized by practicing the embodiments as described in the written description and claims hereof, as well as within the appended drawings.

It is to be understood that both the preceding summary description and the following detailed description are merely exemplary, and are intended to provide a general overview and/or framework to understand the nature and structure of the claims.

The accompanying drawings are included to provide a further understanding, and are incorporated herein and comprise a part of this specification. The drawings illustrate one or more embodiments, and together with the summary description and detailed description serve to explain principles and functions of the various embodiments.

BRIEF DESCRIPTION OF THE FIGURES

FIGS. 3A-3B also feature at least one vertical divider panels, which fits securely into an array of slots and/or support guides thereby creating variable sized compartments into which diverse geometries of similar or differing food ware types can be stabilized and held firmly in upright positions for storage and/or transportation;

DETAILED DESCRIPTION

Reference will now be made in detail to the embodiments, examples of which are illustrated in the accompanying drawings, in which some, but not all embodiments are shown. The concepts may be embodied in many different varieties and should not be construed or interpreted as limiting herein; rather the various embodiments are provided so that the whole of this disclosure will satisfy applicable legal requirements. Whenever possible, similarly referenced numbers will be used to refer to like components or parts.

Embodiments disclosed herein include food product stabilization systems employing proportionately designed shapes, expandable, contractible and/or pivoting support features to protect, brace, store and transport upright food wares, and related components and methods. Upright food products such as cakes, breads, pastries, casseroles etc. frequently require protection from the outside environment, for normal food preservation, and means of storage and/or transportation wherein upright food wares are moved from one location to another. In cases where upright food wares are moved, even in instances of a short distance, unwanted tipping, crumbling, collapsing, falling and/or shifting may occur, which may damage various food products. In cases where partly consumed and/or smaller portions of food wares are stored in larger containers intended for larger food products, such as a whole cake, wasted space becomes a frequent problem when storing smaller fractional portions of food wares. The food product stabilization, storage and transportation systems features one or more proportionately designed shapes, expandable, contractible or pivoting support features. In this regard, upright food wares can be efficiently protected, braced, stored and/or transported in a markedly more secure manner thus preventing unwanted damage to various food wares.

It is hereby noted that food product stabilization features comprise a diverse combination of customizable geometric, material and structural features provided as part of a food product stabilization, storage and transport system to provide specific bracing, buttressing and protection for food wares throughout different stages of consumption, storage and/or food product transport. Geometric features may include, for example, "L" shaped stands, hinges, divider panels, slots, guides, arcs, lines, contoured edge designs, foundation bases, covers, lids, carrying devices, back supports and/or structural supports.

Figure 1A:
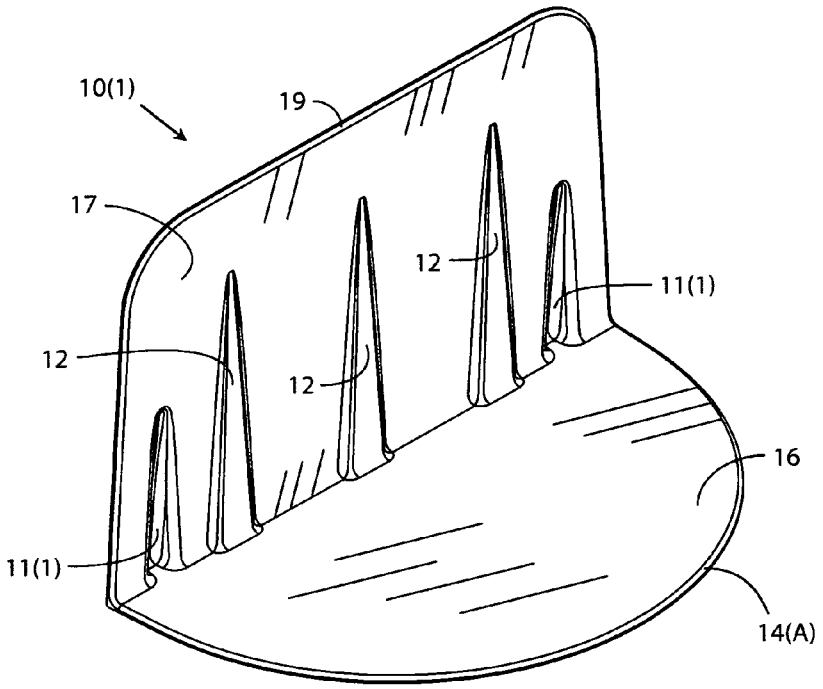
FIG. 1A is close-up perspective side view of an exemplary first embodiment of an upright "L" shaped food product stabilization restraint article that features a circular shaped horizontal lower base and includes at least one integrated back-support element and at least one included panel stiffening facet incorporated into the upright vertical panel of the food product stabilization restraint article.

In order to illustrate the fundamental concepts of this disclosure, FIG. 1A is a perspective side view of an exemplary food product stabilization article 10(1) comprised of a horizontal lower base 16 featuring a semicircle shaped perimeter edge 14(A), which extends inward toward a vertical side panel 17 thereby creating an "L" shape and further comprising a contoured vertical perimeter edge 19 of vertical side panel 17 upon which back-support features 11(1) are incorporated for added upright stability and a plurality of panel stiffeners 12 are integrated for additional upright rigidity, support and stability.

Figure 1B:
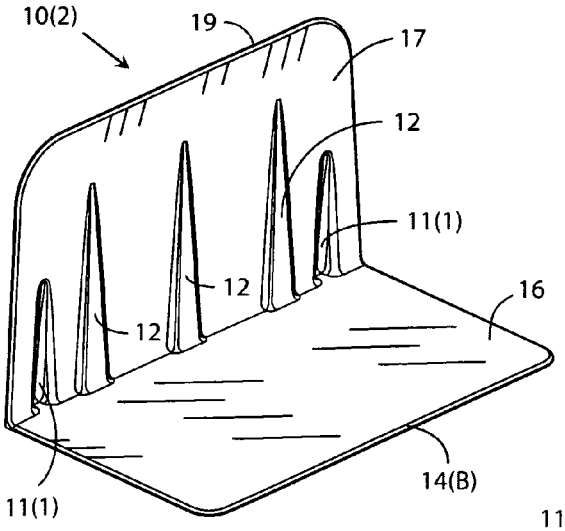
FIG. 1B is a perspective side view of an upright "L" shaped restraint article having a rectangular shaped horizontal base and at least one integrated back-support and at least one panel stiffener included in the vertical panel of the upright restraint article.

The food product stabilization article 10(2) of FIG. 1B is also an "L" shape formed by means of horizontal lower base 16 extending inward toward vertical side panel 17, however the horizontal based 16 in FIG. 1B features a rectangular shaped perimeter edge 14(B) depicting different edge geometry that can be disposed along the boundary edges 14(A) of FIG. 1A or 14(B) of FIG. 1B of horizontal base 16. Indeed, various edge geometries such as contours, arcs, and/or lines can be incorporated into the horizontal perimeter edges 14(A) of FIG. 1A or 14(B) of FIG. 1B of horizontal base 16 and/or upon the vertical perimeter edge 19 of vertical side panel 17 of FIGS. 1A-B in order to create custom shapes, which conform to specific edge geometry of various food product types.

Figure 1C:
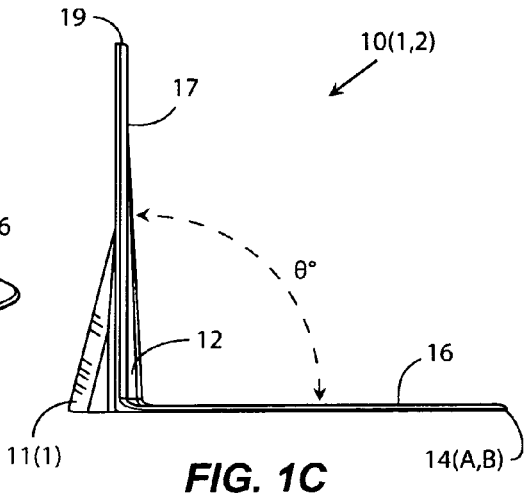
FIG. 1C is a side view of either FIG. 1A or FIG. 1B showing a more detailed view of a back-support element as well as the proportional thickness of a panel stiffener.

With continuing reference to FIG. 1A-1B, FIG. 1C is a side view of the food product stabilization article embodiments of either 10(1) or 10(2) to further illustrate the back-support elements 11(1) and to further depict the proportional tapered thickness of a panel stiffeners 12. As seen in FIG. 1C, the back support elements 11(1) may extend further outward from vertical panel 17 in order to provide additional buttressing to help avoid tipping when being used to support various food wares. Additionally, at least one panel stiffener 12 may be incorporated into vertical panel 17 to provide added upright structural support and thus prevent unwanted flexing while supporting heavier types of food products. It is noted that panel stiffeners 12 may be thicker toward the horizontal base 16 and gradually taper inward while extending vertically toward the topmost portion of vertical side 17. In this manner, the desired angle θ° between horizontal base 16 and vertical side 17 may be held more securely fixed and thus prevent unwanted flexing while supporting heavier types of food products. Although angle θ° may be predetermined at time of manufacturing to accommodate different types of food product geometry, in its preferred embodiment, angle θ° is approximately 90° to form an exemplary "L" shaped restraint of the food product stabilization articles of either embodiments 10(1) or 10(2).

Now that the "L" shaped stabilization and/or restraint articles 10(1) and 10(2) have been described using FIGS. 1A-1C, various examples of food product stabilization systems will discussed relative to FIGS. 2A-7B. Then FIG. 8 will be described in relation to an improved method for transferring or relocating various food products from one storage container to another and/or storing disclosed art within traditional containers.

Figure 2A:
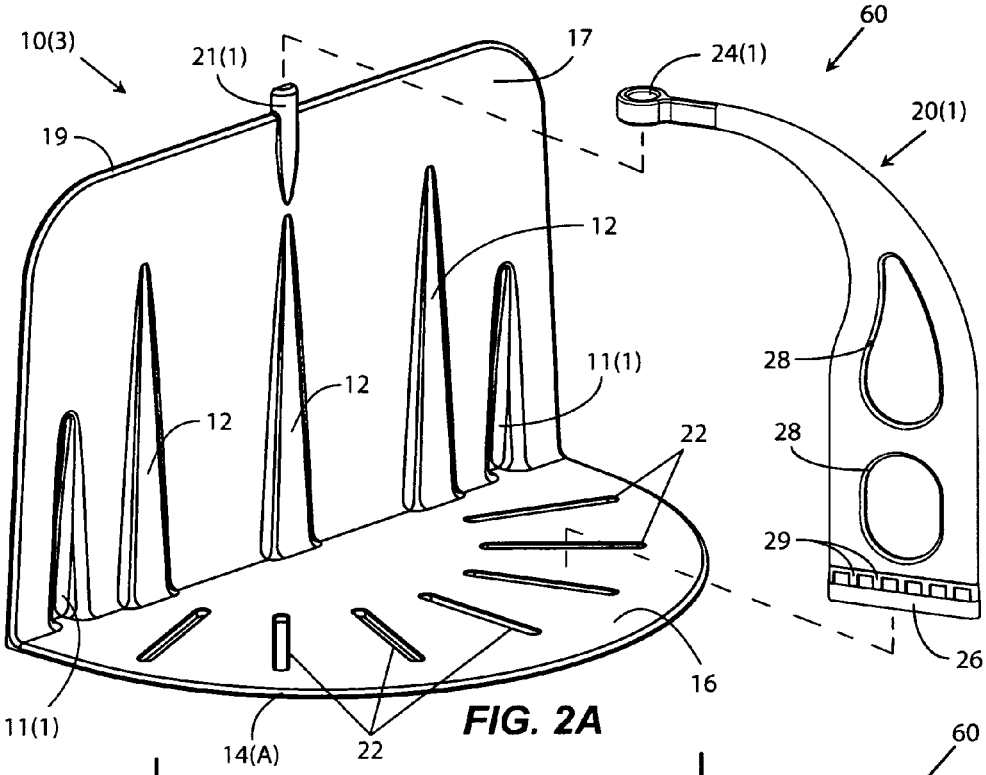
FIGS. 2A-2C are perspective side views of another embodiment of a food product stabilization system that employs at least one rotatable hinge that can pivot about an axis and fit securely into an array of slots and/or guides to alter the positions and vary the shapes into which food wares can be stabilized and held firmly in an upright position.
Figure 2B:
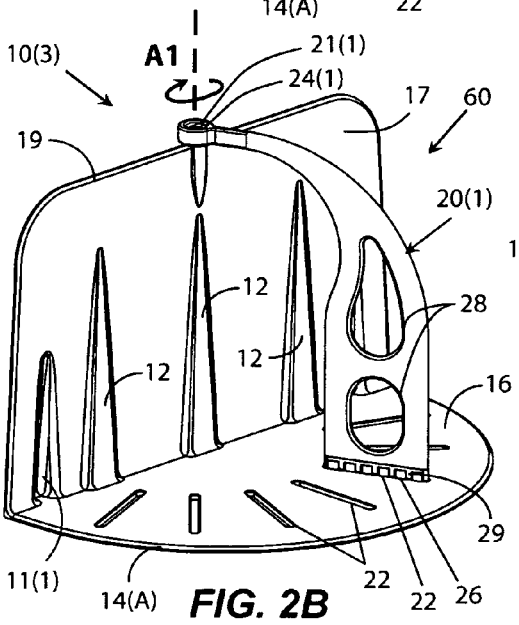
Figure 2C:
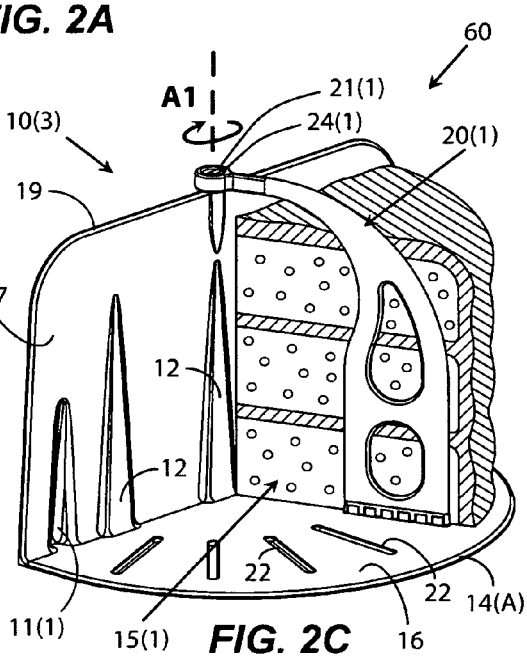

In this regard, FIGS. 2A-2C are all perspective side views of another embodiment of a food product stabilization system 60, which features a rotatable hinge panel 20(1) used to create customizable food compartments in combination with another "L" shaped embodiment 10(3). Similar to previous FIGS. 1A-1C, the food product stabilization article 10(3) of FIG. 2A is comprised of an "L" shaped restraint article 10(3) having a horizontal base 16, vertical side panel 17, panel stiffeners 12 and back-supports 11(1) and now further comprises a vertical cylinder 21(1) onto which thru-hole 24(1) of rotatable hinge panel 20(1) may be positioned. FIG. 2A further comprises an array of horizontal slots 22 formed into the horizontal base 16 of restrain article 10(3) into which the lower base portion 26 of rotatable hinge panel 20(1) may be securely fitted thereby creating a locked vertically upright hinge panel 20(1) separator that is held fixed into position by means of the connectivity between thru-hole 24(1) and vertical cylinder 21(1) and further union of base portion 26 being locked into any of the horizontal slots 22 of horizontal base 16. It is noted that locking geometry 29 may be incorporated into the rotatable hinge panel 20(1) as means of further securing base portion 26 into horizontal slots 22. Geometry 29 may limit the depth of the lower base 26 into horizontal slots 22.

With continuing reference to FIG. 2A, FIGS. 2B-2C are both perspective side views of FIG. 2A with FIG. 2B showing an assembled component view and FIG. 2C depicting the food product stabilization system 60 being used in combination with upright food wares 15(1). FIG. 2B illustrates the upright hinge panel 20(1) now being assembled onto the "L" shaped restraint article 10(3) by thru-hole 24(1) fitting onto the vertical cylinder 21(1) and thus creating axis A1 around which the upright hinge panel 20(1) may freely pivot. Upright hinge panel 20(1) pivots about axis A1 allowing the base portion 26 to then lock into any part of the array of horizontal slots 22 of horizontal base 16 thereby creating a multitude of customizable positions for bracing and/or supporting food wares.

FIG. 2C depicts the assembly of FIG. 2B being used in combination with an exemplary upright food product 15(1). In this non limiting example, the upright food product 15(1) is a portion of a free-standing layer-cake disposed onto the food product stabilization system 60. In this manner, any segmented size of upright food wares 15(1) are disposed in an abutting horizontal relationship with the base portion 16 of the "L" shaped restraint article 10(3) and further disposed in two abutting vertical relationships, the first being the vertical side portion 17 of the "L" shaped restraint article 10(3) and the second being upon the vertically upright hinge divider panel 20(1) of food product stabilization system 60. In this regard, the upright hinge divider panel 20(1) may be removed, depicted in FIG. 2A, and an approximate 180° semi-circle is created as shown by horizontal perimeter edge 14(A) of the "L" shaped restraint article 10(3). Further, the upright hinge divider panel 20(1) may be installed, depicted in FIGS. 2B-2C, allowing for customizable positions of bracing and/or stabilizing the upright food product 15(1) as smaller and smaller segments are created throughout various stages of food consumption.

Figure 3A:
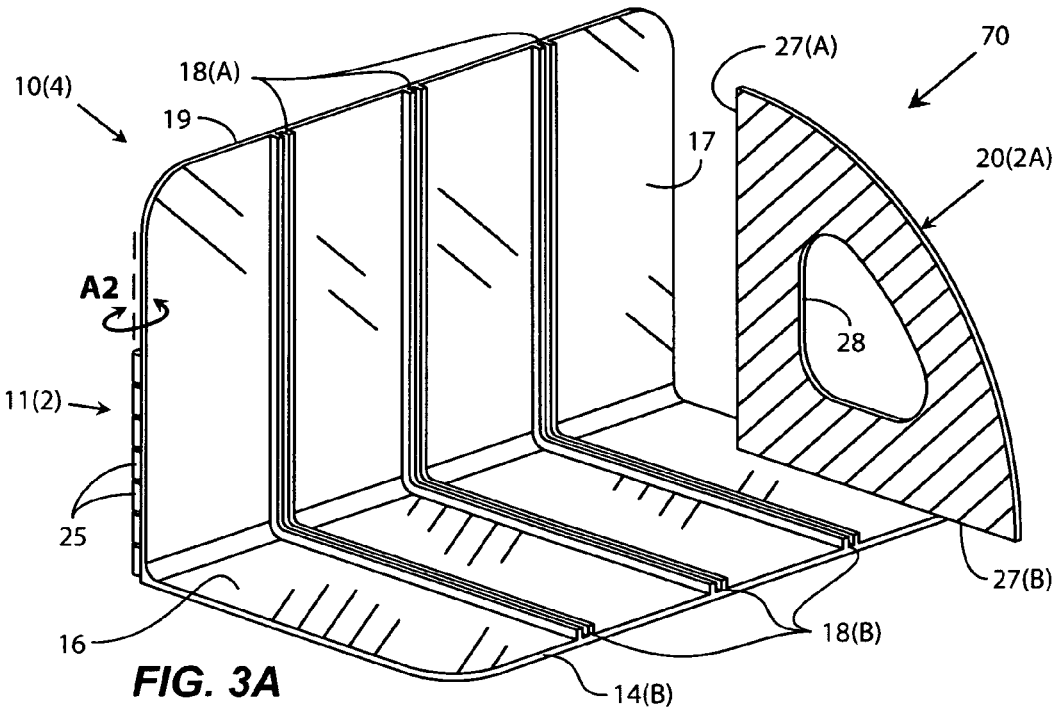
FIGS. 3A-3B are perspective side views of another embodiment of a food product stabilization system that features at least one incorporated back-support that is hinged and can be collapsed into a space-saving position or pivoted outward to provide additional upright stability.
Figure 3B:
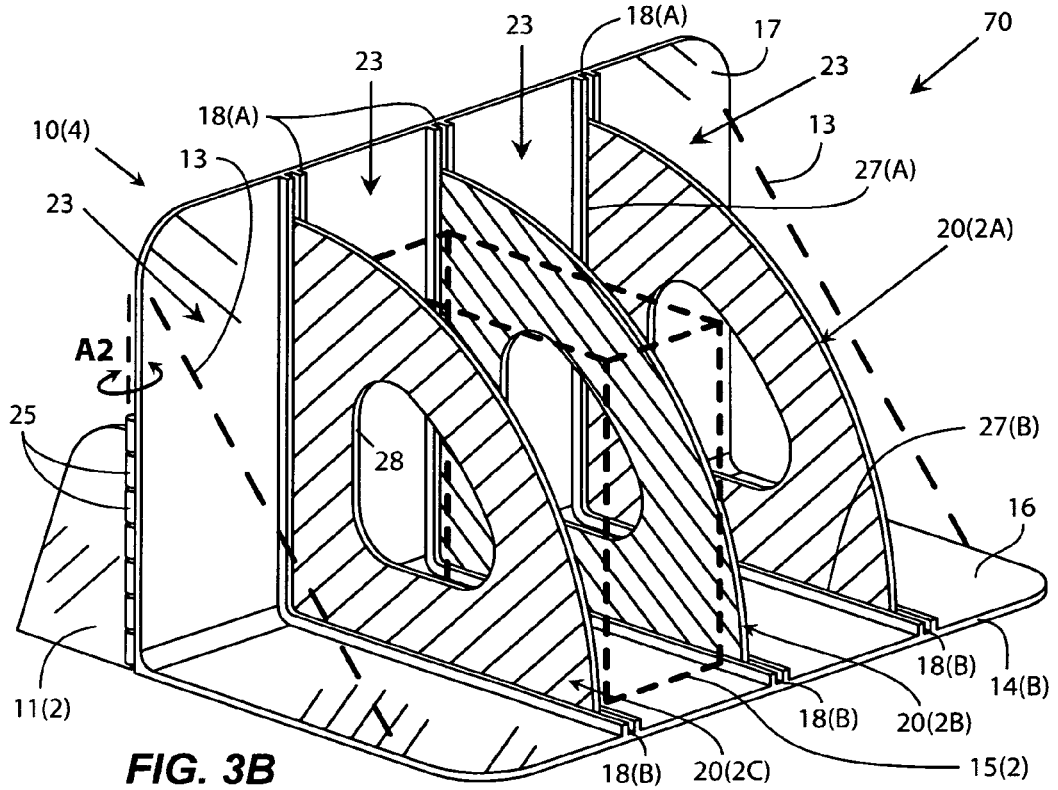

The upright food products 15(1), 15(2) may vary is size, shape and type creating a potential need for additional separations and/or multiple compartment dividers. FIGS. 3A-3B are perspective side views of another embodiment of a food product stabilization system 70 comprised of a new embodiment of an "L" shaped restraint article 10(4) and further embodiments of divider panels 20(2A)-20(2C). The food product stabilization system 70 further comprises a plurality of both vertical slots or guides 18(A) and horizontal slots or guides 18(B) into which at least one of the vertical divider panels 20(2A)-20(2C) may be positioned thereby creating customizable compartments 23 into which different sizes and types of upright food wares 15(2) may be compartmentalized, divided and held secure. The food product stabilization system 70 may further comprise at least one integrated back-support element 11(2) designed to freely pivot upon a vertical hinge axis A2 of hinge 25 in order for the back-support element 11(2) to be collapsed into a space-saving position for storage as depicted in FIG. 3A or the back-support element 11(2) may be pivoted outward about axis A2 of hinge 25 into a generally perpendicular relationship with the vertical side 17 of the "L" shaped restraint article 10(4) as depicted in FIG. 3B and thereby provide additional vertical support and further prevent any unwanted tipping or spillage during storage or transport of upright food products 15(2). The "L" shaped restraint article 10(4) of food product stabilization system 70 may also comprise optional end-panels 13. The vertical edge portions 27(A) of divider panels 20(2A)-20(2C) are able to lock into vertical guides 18(A) and horizontal base portions 27(B) of divider panels 20(2A)-20(2C) are able to lock into horizontal guides 18(B).

Figure 4A:
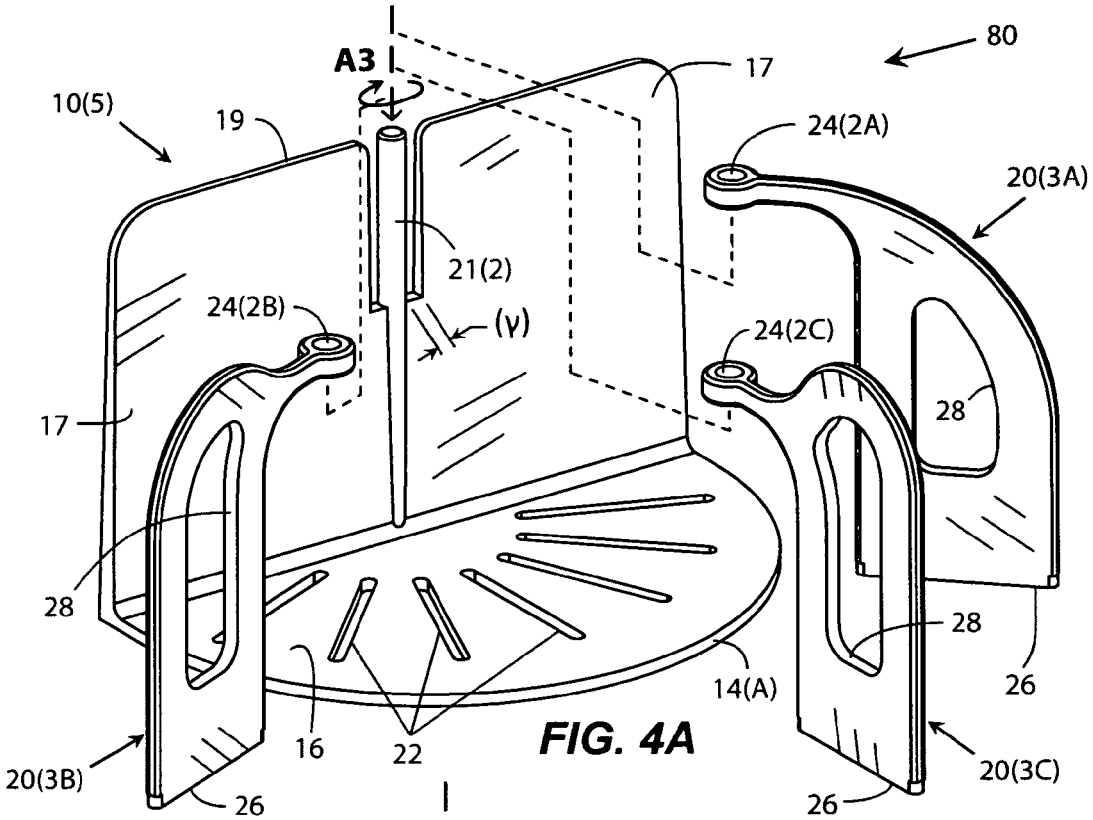
FIGS. 4A-4B are perspective side views of another embodiment of a food product stabilization system that employs a plurality of rotatable hinges that can each pivot about a common axis and fit securely into an array of slots and/or guides to alter and create multiple compartment positions into which various sized food wares can be accommodated, stabilized and held firmly into numerous customizable upright positions.
Figure 4B:
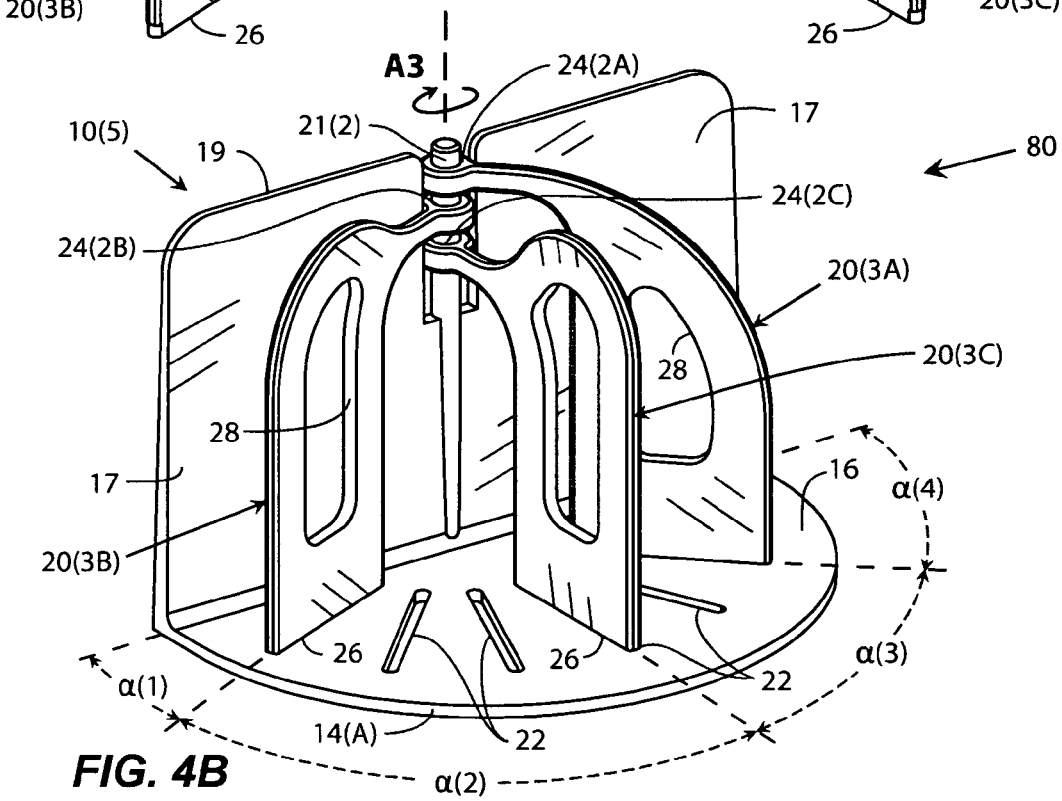

With reference back to FIGS. 2A-2C, it may be desirable for the "L" shaped restraint article 10(3) of food product stabilization system 60 to feature an ability to hold more than one upright hinge divider panel 20(1) to create differently sized food storage compartments, and so FIGS. 4A-4B are perspective side views of another embodiment of a food product stabilization system 80, which comprises an exemplary embodiment of an "L" shaped restraint article 10(5) featuring an elongated vertical cylindrical 21(2) and further comprises multiple embodiments of a plurality of vertically upright hinged divider panels 20(3A)-20(3C). FIG. 4A depicts an exploded perspective side view of an "L" shaped restraint article 10(5) having a horizontal base 16, vertical side panel 17 and an array of horizontal slots 22 formed into the horizontal base 16 of restrain article 10(5). The "L" shaped restraint article 10(5) further comprises an elongated vertical cylindrical 21(2) onto which thru-holes 24(2A)-24(2C) of rotatable hinge panels 20(3A)-20(3C) may be positioned in a vertically stackable relationship creating axis A3 around which hinge panels 20(3A)-20(3C) may freely pivot and adjust. Similar to FIGS. 2A-2C the "L" shaped restraint article 10(5) also comprises an array of horizontal slots 22 formed into the horizontal base 16 of restrain article 10(5) into which all of the lower base portion 26 of rotatable hinge panels 20(3A)-20(3C) may be securely fitted thereby creating a plurality of locked vertically upright hinge-panel separators 20(3A)-20(3C), which are each held fixed into position by means of the connectivity between thru-holes 24(2A)-24(2C) and the elongated vertical cylinder 21(2) and further horizontal union of the base portions 26 being firmly locked into any of the horizontal slots 22 of horizontal base 16.

FIG. 4B depicts an assembled perspective side view of FIG. 4A and further illustrates the multiple segmented compartments α(1), α(2), α(3) and α(4) that may be created and customized by differently angled relationships between vertical side panel 17 and the various pivoted positions of the upright hinge-panel separators 20(3A)-20(3C), or solely between the differently angled positions of the vertical hinge-panel separators 20(3A)-20(3C). It is noted that more or less hinge-panel separators may be used to created a greater or lesser number of segmented compartments α(1), α(2), α(3) and α(4). Further, all of the previously described panel separators of FIGS. 2A-4B may include custom designed thru-ways 28 for either aesthetic appeal or material reduction, or both.

With continuing reference to FIG. 4B, it is noted that the vertically stackable relationship between the elongated vertical cylindrical 21(2) of the "L" shaped restraint article 10(5), and the thru-holes 24(2A)-24(2C) of rotatable hinge panels 20(3A)-20(3C), may be achieved through differently sized vertical height configurations of thru-holes 24(2A)-24(2C). Additionally, it is further noted that the vertically stackable relationship between the elongated vertical cylindrical 21(2) of the "L" shaped restraint article 10(5), and the thru-holes 24(2A)-24(2C) of rotatable hinge panels 20(3A)-20(3C), may require gap gamma (y) within side panel 17 to be sufficiently sized along perimeter edge 19 of side panel 17 and the elongated cylindrical 21(2) of the "L" shaped restraint article 10(5).

Figure 5A:
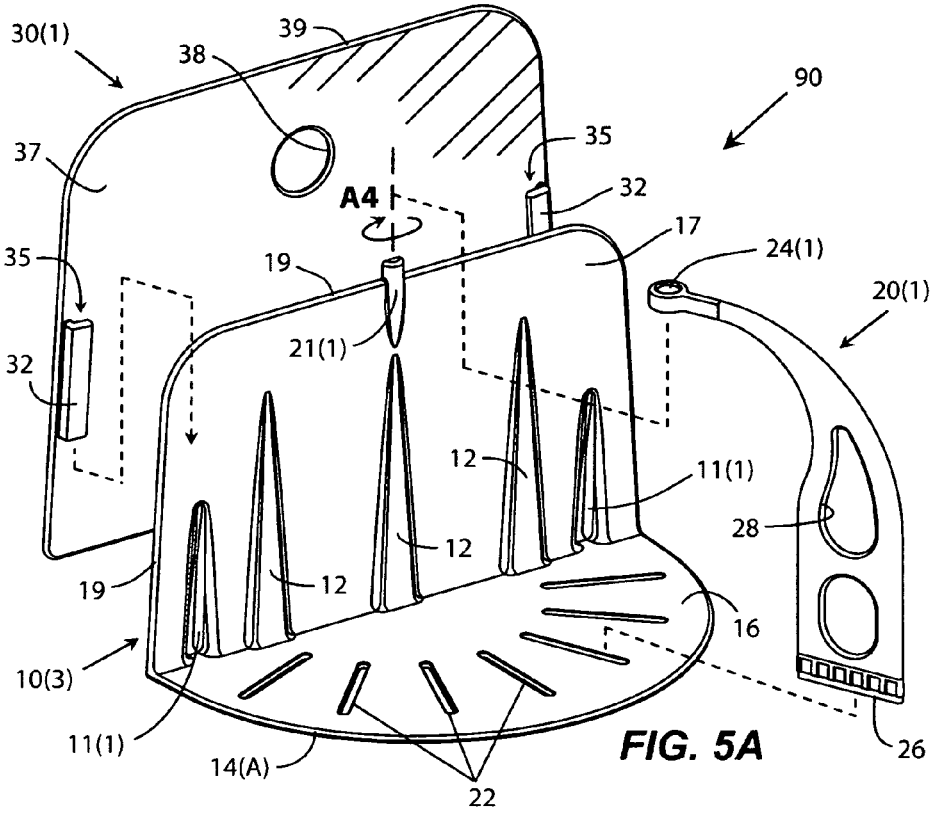
FIGS. 5A-5B are perspective side views of FIGS. 2A-2B, which also feature an at least one adjustable height panel to further customize and adjust the upright vertical support-panel geometry for taller or shorter food wares thereby creating added stability for a wide variety and diverse assortment of differently sized upright food wares.
Figure 5B:
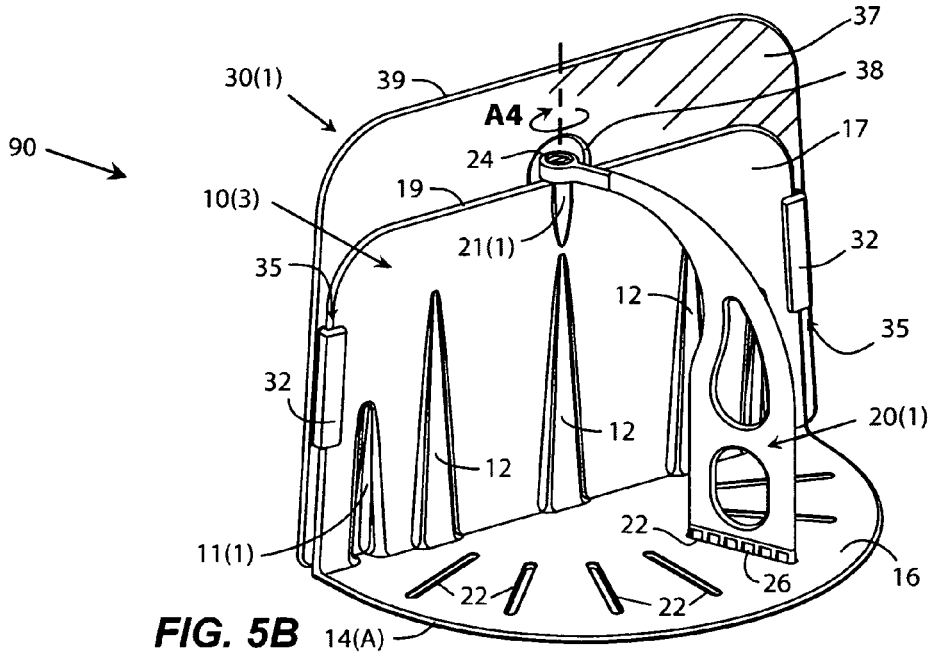

With additional reference back to FIGS. 2A-2C, it may be desirable for the "L" shaped restraint article 10(3) of food product stabilization system 60 to feature an ability to exhibit additional vertical height adjustability to accommodate taller food or shorter food products. Accordingly, FIGS. 5A-5B are perspective side views of another embodiment of a food product stabilization system 90, which comprises the previously disclosed embodiment of an "L" shaped restraint article 10(3) of the food product stabilization system 60 of FIGS. 2A-2C, which now further comprises an at least one adjustable height panel 30(1) that may be positioned to further customize and adjust the upright vertical support-panel geometry for taller or shorter food products and thereby creating added vertical stability for a diverse assortment of differently sized upright food products. The adjustable height panel 30(1) may feature, for example, a thru-way 38 so that rotatable hinge panel 20(1) may pivot freely about axis A4 without obstruction.

FIG. 5A is an exploded perspective side views depicting one embodiment of an adjustable height panel 30(1) placed behind the "L" shaped restraint article 10(3) in a manner to demonstrate how the adjustable height panel may be positioned by means of edge-clips 32. Edge-clips 32 may, for example, be spaced away from panel-face 37 in order to create gap 35 that is sized sufficiently to slide over both perimeter edge 19 and side panel 17 of the "L" shaped restraint article 10(3). In this manner, the height of the food product stabilization system 90 may be vertically adjustable to support taller food items, where perimeter edge 39 is now vertically taller than perimeter edge 19 as seen in FIG. 5B. It is noted that the hinge panel 20(1) may still function as previously described.

With supplementary reference back to FIGS. 2A-2C, it may also be desirable for the "L" shaped restraint article 10(3) and rotatable hinge panel 20(1) of food product stabilization system 60, as well as any variety of upright food wares 15(1) to be enclosed within uniquely designed containers to further protect and store any combination of the previously disclosed food product stabilization systems and associated food wares 15(1). Since the disclosed food product stabilization systems are invented partly to protect, brace, and store upright food wares, it may also be desirable for the uniquely designed containers to feature additional restraints and/or bracing facets to provide further stability. It may also be advantageous for uniquely designed containers to exhibit an overall shaped that is formed and intended to provide space savings of less than whole food products. Accordingly, FIGS. 6A-6B are perspective side views of another embodiment of a food product stabilization system 100, which comprises the previously disclosed embodiment of an "L" shaped restraint article 10(3) and the rotatable hinge panel 20(1) of the food product stabilization system 60 of FIGS. 2A-2C, but now further comprises a unique base platform 50(1) and a formed top cover 40(1) each designed to fit securely together.

Figure 6A:
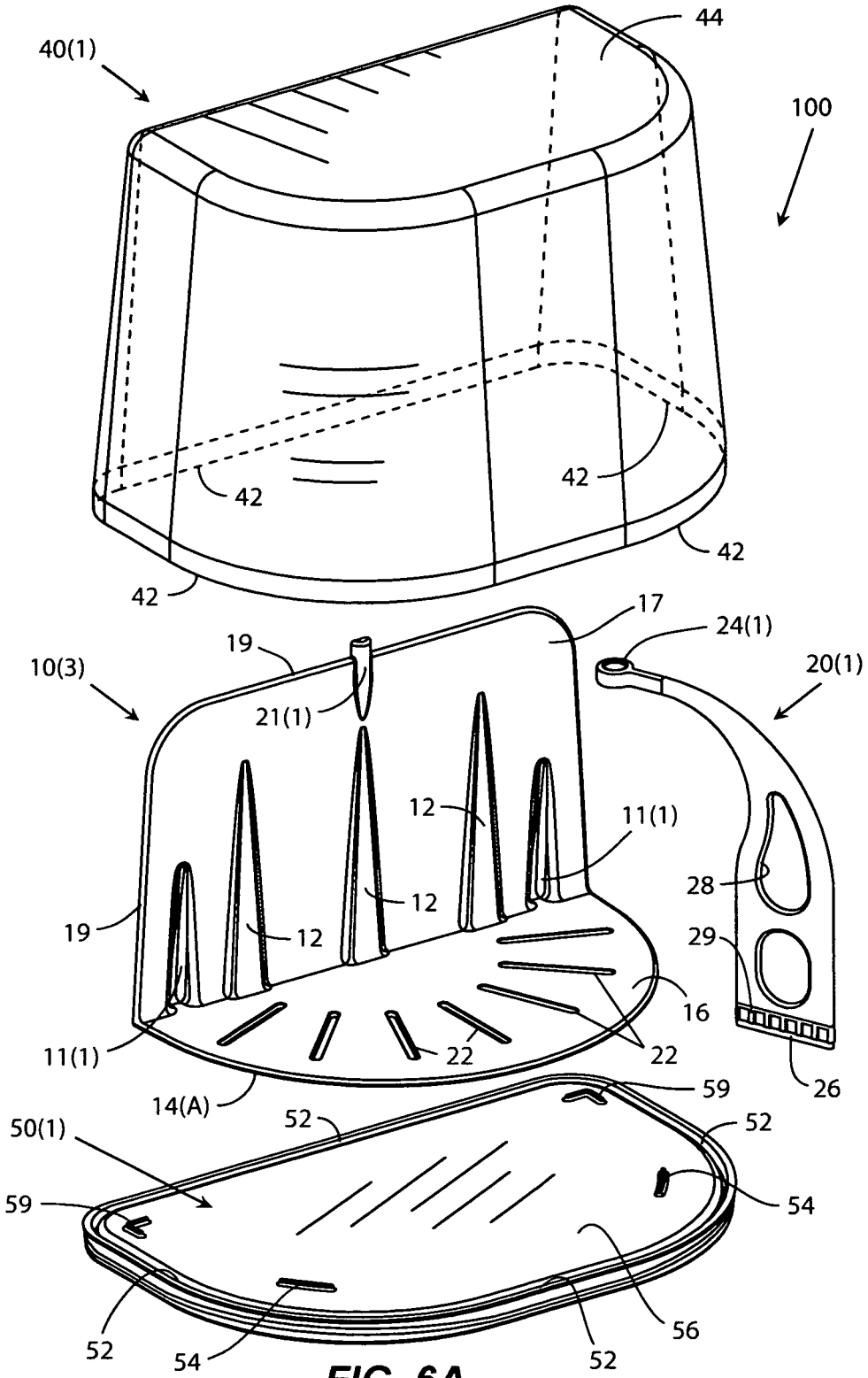
FIG. 6A is an exploded perspective side view of FIG. 2A that further comprises an exemplary first embodiment of a horizontal base platform onto which the food product stabilization system of FIG. 2A can be secured, and then another exemplary first embodiment of an upright top-cover can then lock securely onto the horizontal base platform and thereby contain the food product stabilization system of FIG. 2A et al.

Referencing FIG. 6A, which is an exploded perspective side view, the unique base platform 50(1) may, for example, feature bracing facets 54 and 59, where the back bracing facets 59 may secure edge 19 of vertical side panel 17 while the front bracing facets 54 may further secure perimeter edge 14(A) of horizontal base 16. In this manner, the "L" shaped restraint article 10(3) may fit securely into bracing facets 54 and 59 of the unique base platform 50(1) as seen in FIG. 6B and thereby provide additional protection against unwanted sliding during transport of the food product stabilization system 100. It is noted that a non-slip treatment may exist upon top surface 56 of base platform 50(1) creating friction and an enhanced grip between the horizontal base 16 and top surface 56.

With continuing reference to FIG. 6A, it is noted that lower perimeter edge 42 of top cover 40(1) is expressly formed to fit into the perimeter groove 52 of the unique base platform 50(1). The pre-formed shape of top cover 40(1) is comprised of a relationship of the lower perimeter edge design 42 extending upward toward a top surface 44 and thusly, can be of any desired perimeter and vertical shape to accommodate any variety of food products and the previously disclosed food product stabilization systems.

Figure 6B:
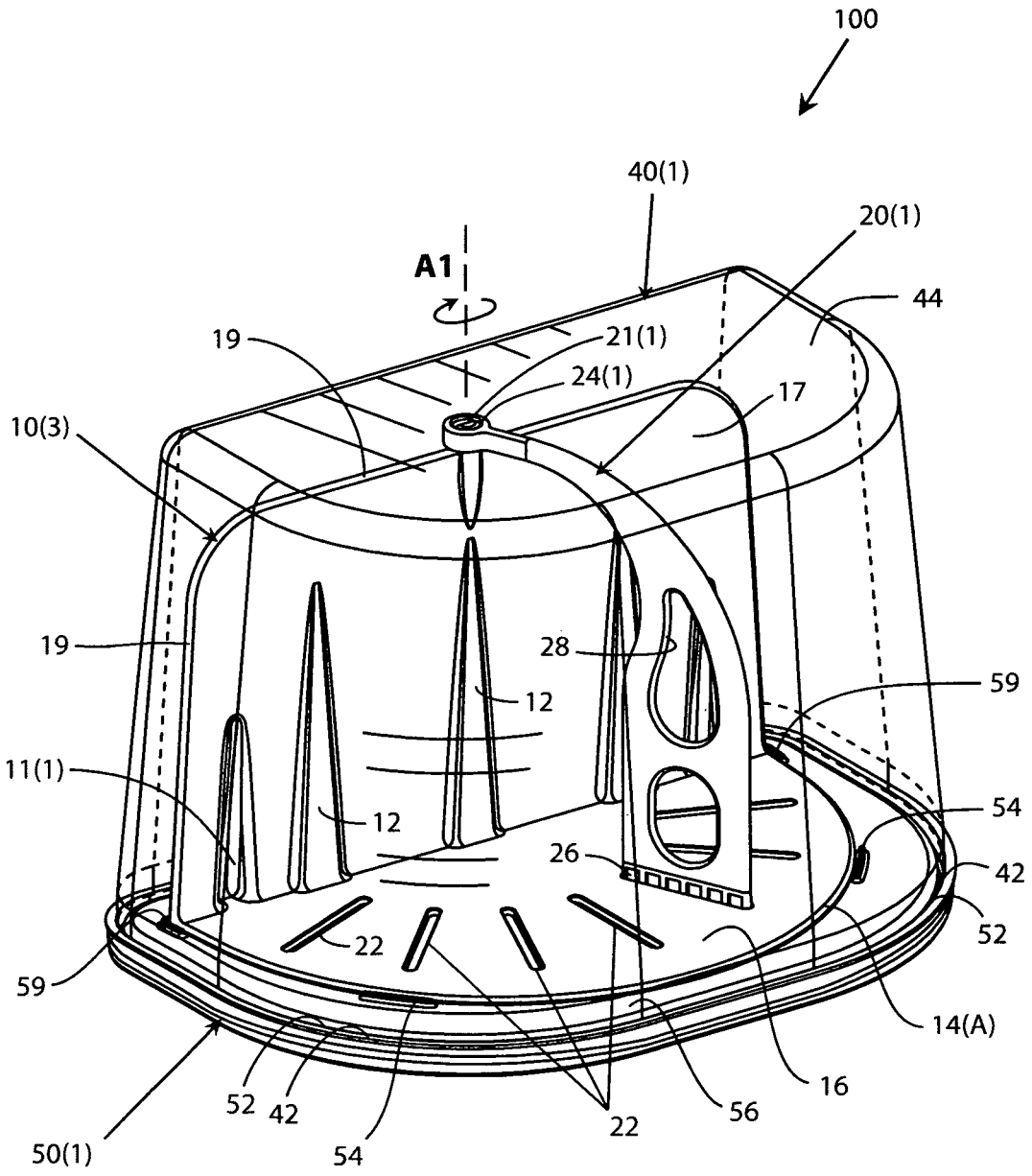
FIG. 6B is an assembled perspective side view of FIG. 6A wherein FIG. 2B et al is securely contained between the horizontal base platform and the upright top cover.

Referencing the assembled food product stabilization system 100 of FIG. 6B, it is observed that the pre-formed top cover 40(1) in this example is transparent and may display the contents therein. FIG. 6B further depicts the connective relationship between the back bracing-facets 59 and perimeter edge 19 of vertical side panel 17, as well as the front bracing-facets 54 and perimeter edge 14(A) of horizontal base 16. In this manner, any variety of food products are markedly more braced, secured in place and significantly better protected within the disclosed food product stabilization and storage system 100.

Figure 7A:
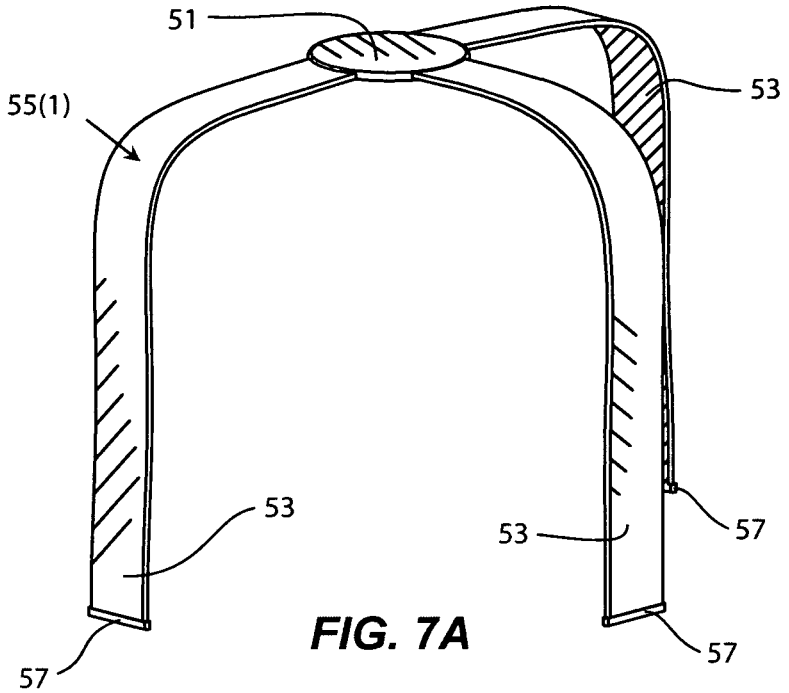
FIG. 7A is a perspective side view of an exemplary first embodiment of a carrying apparatus that is designed to fit securely onto food product container elements.
Figure 7B:
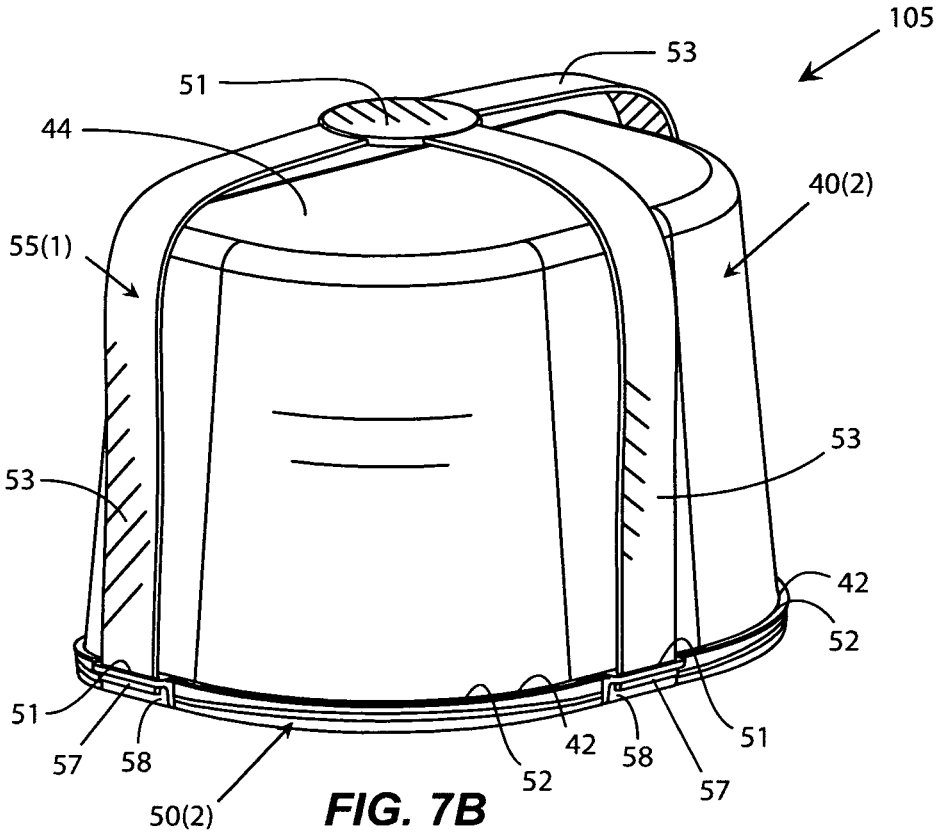
FIG. 7B is an assembled perspective side view of the carrying apparatus seen in FIG. 7A that is now engaged upon another embodiment of a horizontal base featuring locking side-tabs and fitting securely onto another embodiment of an opaque top-cover, enclosing any variety of the food product stabilization elements and/or system(s) and thereby creating an efficient food product stabilization, protection and transport system.

With reference back to FIGS. 6A-6B, it may also be desirable for any of the previously disclosed food product stabilization and storage systems to further comprise a method of carrying for easy transportation from one location to another and therefore FIGS. 7A-7B are perspective side views of another embodiment of a new food product stabilization, storage and transportation system 105, which further comprises at least one carrying strap 55(1) featuring quick-connect tabs 57 of straps 53 that are both designed to operate in conjunction with slots 51 of locking-latch 58 of a new embodiment of a base platform 50(2). The locking-latches 58 of base platform 50(2) may, for example, be pre molded into the base platform 50(2) and thereby provide added carrying strength. As seen in FIG. 7A, a convenient carrying handle 51 may be disposed between the carrying straps 53 and located at a topmost position to accommodate a means of suitable carrying. FIG. 7B is an assembled perspective side view that depicts a unique base platform 50(2) with locking latches 58, an opaque top cover 40(2), which may enclose and contain any of the previously disclosed food product stabilization systems, and finally a carrying strap 55(1) with quick-connect tabs 57 fitting securely into slots 51 of locking latches 58. Like FIGS. 6A-6B, the lower perimeter edge 42 of top cover 40(2) is expressly formed to fit into the perimeter groove 52 of the base platform 50(2) as seen in FIG. 7B. Further, it is noted that quick-connect tabs 57 and locking latches 58 may be comprised of any type or style of locking connectors. In this manner, a considerably more complete food product stabilization, storage and transportation system 105 is created to efficiently protect, store, brace, preserve and transport any variety of food wares in a more secure fashion and thus prevent unwanted damage to any assortment, shape or size of upright food products.

Figure 8:
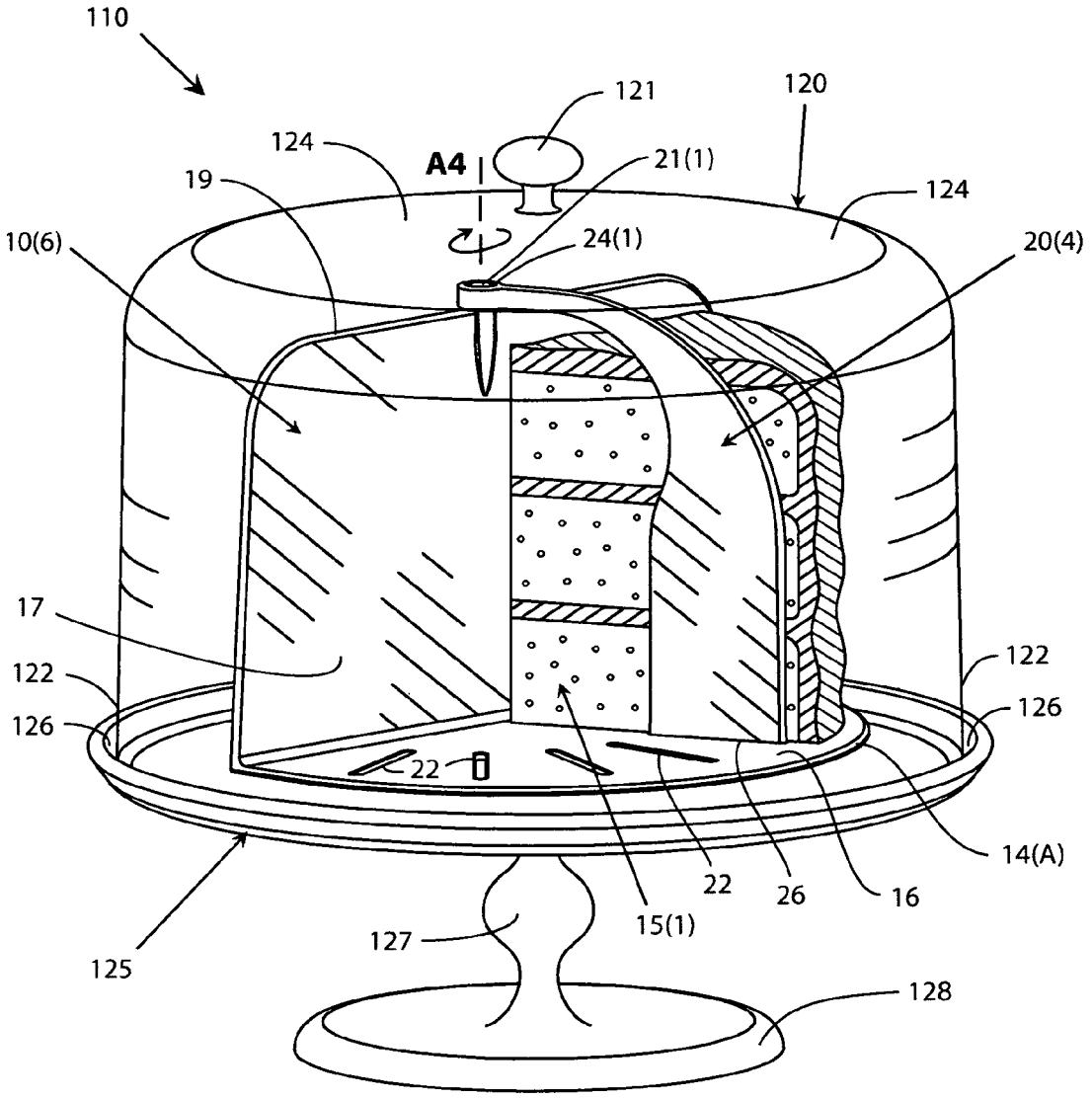
FIG. 8 depicts a perspective side view of another embodiment of a food product stabilization system with a solid upright panel and a solid rotatable hinge securing a portion of a cake and all being enclosed within a transparent prior-art storage container, demonstrating the ease with which upright food wares can be moved from the food product storage containers of FIGS. 6B and 7B to other traditional food containers without causing undesirable damage such as tipping, crumbling and/or collapsing.

FIG. 8 is a perspective side view of another embodiment of a food product stabilization system 110 that is contained within a traditional food storage and/or display container. In this example, the traditional container is a cake display container, which is comprised of a lower base 125 and an upper lid 120. As seen in some prior-art display containers, the lower base 125 features a decorative stem 127, a lower base surface 128 and a perimeter edge 126 onto which an upper lid 120 may be positioned. The upper lid 120 often features a top surface 124, a topmost handle 121 and side walls 122 that are designed to fit upon the perimeter edge 126 of lower base 125. Now that the prior-art display container has been described, additional features and benefits will be discussed to describe an improved method for transferring and/or relocating various food products from any storage device to another and thus reduce or prevent any unwanted damage to upright food wares while they are being relocated from one storage container to another.

FIG. 8 depicts a new embodiment of an "L" shaped restraint article 10(6) as well as a new embodiment of a rotatable hinge panel 20(4). In this example, the "L" shaped restraint article 10(6) is comprised of a stronger, more durable material and does not require panel stiffeners or ancillary back-support elements. Similarly, the rotatable hinge panel 20(4) is solid and omits any type of thru-ways. It is noted that both the food product stabilization system 110 and all previously disclosed food product stabilization, storage and/or transport systems and embodiments may be comprised, for example, of almost any type of material such as metals, woods, synthetics, plastics and/or composites or any derivative thereof. In their preferred embodiments, the food product stabilization, storage and/or transport systems and/or embodiments may be manufactured via injection and/or blow molding processes and be comprised of any known polymeric thermoplastic.

Non-limiting examples of polymeric thermoplastic materials that may be used include polyethylenes, polypropylenes, copolymers, ethylene vinyl acetates, polystyrenes, thermoplastic olefins, thermoplastic polyester, polyvinyl chlorides, ethylene methyl acrylates, chlorinated polyethylene, polyolefins and the like, and derivatives thereof.

With continuing reference to FIG. 8, it is observable that the food item 15(1), a free standing layer cake in this example, is positioned in horizontal relationship upon lower base 16 portion of the "L" shaped restraint article 10(6) and braced in two vertical relationships, the first abutting upon vertical side panel 17 and the second adjoining the vertical and rotatable hinge panel 20(4), which is secured by a mating relationship of a thru-hole 24(1) and vertical cylinder 21(1) as well as the lower base 26 of rotatable hinge panel 20(4) being affixed into one of the array of horizontal slots 22 of lower base 16. In this regard, the upright food product may be easily moved from one storage container as depicted in FIG. 8 to the previously disclosed storage container system 100, for example, as illustrated in FIGS. 6A-6B, or into the previously disclosed transportation system 105, for example, as portrayed in FIG. 7B, or any derivative thereof by means of picking and placing any disclosed "L" shaped restraint article, which will continue to hold any upright food products 15(1) securely in position during transport from one container to another.

Lacking from prior art methods of moving upright food wares from one location to another is an ability to fully support the underside of the food product 15(1) as well as an absence of vertical buttressing features during transport. In this regards, it is noted that the lower perimeter edges, 14(A,B) of FIGS. 1A-C for example, of lower base portion 16 of any "L" shaped restraint article may be formed with a blade-like edge in order for any of the perimeter edges 14(A,B) in combination with lower base portion 16 to function in a manner similar to a spatula edge to easily slide under any food product 15(1) regardless of the surface that the food products 15(1) may reside upon. It is further noted that, unlike traditional spatulas, the horizontal base 16 of all of the "L" shaped restraint articles may function as an oversized spatula and thus fully encompass the lower portion of food product 15(1) during relocation. Additionally, any of the aforementioned vertical panels and/or hinges, as seen in food product stabilization system 60 of FIG. 2C for example, will provide supplementary vertical support upon at least two vertical surfaces of food product 15(1) during transport and/or relocation. In these regards, any of the previously disclosed "L" shaped restraint articles may function a both a spatula to easily slide under any upright food product 15(1), and as a carrying or transport device that may, in combination with any disclosed vertical panels and/or hinges, easily lift and securely hold large food wares such as cakes, breads, casseroles, pastries and the like. Accordingly, an improved method is realized for transferring or relocating food products from one storage and/or transport device to another thus preventing unwanted damage.

Many additional alterations, modifications and/or other variations of the embodiments disclosed herein will come to mind to one skilled in the art to which the embodiments may be relevant having the benefit of the teachings presented in the foregoing descriptions and the associated drawings. Therefore, it is to be expressly understood that the descriptions and claims are not to be limiting in any way to the specific embodiments disclosed and that modifications and other embodiments are hereby intended to be included within the scope of the appended claims. It is further intended that the disclosed description and embodiments cover any modifications and variations of the embodiments provided they come within the scope of the appended claims and their equivalents. Although many different specific terms are employed herein, they are used in a generic sense and in a descriptive sense only and not for purposes of limitation.

PATENT CITATIONS

| Cited Patent | Filing Date | Pub. Date | Applicant | Title |
|---|---|---|---|---|
| 3,677,168 | Jun. 4, 1971 | Jul. 18, 1972 | R. Gordon Bell et al | pie and cake saver |
| 2,617,350 | Sep. 16, 1949 | Nov. 11, 1952 | Vallie M. Shol et al | cake saver |
| 2,637,617 | Jan. 3, 1950 | May 5, 1953 | A. B. Stotter | receptacle for bakery products |
| U.S. Pat. No. 5,446,965 | May 22, 1992 | Sep. 5, 1995 | Maria Makridis | cake divider |
| U.S. Pat. No. 5,446,965A | May 22, 1992 | Sep. 5, 1995 | Maria Makridis | cake divider |

-continued

| Cited Patent | Filing Date | Pub. Date | Applicant | Title |
|---|---|---|---|---|
| US20130019726A | Jul. 19, 2011 | Jan. 24, 2013 | Richard Rosenbaum | food stabilization device, method and system |
| U.S. Pat. No. 7,480,999B2 | Aug. 11, 2006 | Jan. 27, 2009 | A. Atwater, A. Bartoli | food presentation system and assembly therefor |
| U.S. Pat. No. 4,114,265A | Nov. 4, 1977 | Sep. 19, 1978 | Robert Bailey | cake cutter and server |
| U.S. Pat. No. 5,129,159A | May 4, 1990 | Jul. 14, 1992 | Eduardo C. Fuenzalida | cake divider with ornament support |

I claim:

1. A food product stabilization system comprising:

at least one "L" shaped restraint article comprised of a first horizontal base surface extending inward toward a first vertical side panel, wherein the horizontal base is formed with a spatula edge enabling the horizontal base to slide underneath upright food wares and thus fully support an underside of upright food wares;

a vertical cylinder protruding vertically from the vertical side panel; and at least one vertically upright hinge panel pivotally connected to the vertical cylinder and the at least one vertically upright hinge panel adapted to be disposed in at least one abutting vertically side by side relationship with any upright food wares, the "L" shaped restraint article is adapted to abut the upright food wares at the first horizontal base surface and at the first vertical side panel to enable transfer and/or relocation of the upright food wares from one storage and/or transport device to another.

2. The food product stabilization system of claim 1, wherein the at least one vertically upright hinge panel is adapted to be disposed in an abutting side by side relationship to upright food wares in a manner to bracket, and further stabilize any 180° or less circular portion and/or any whole or fractional square or rectangular portions of vertically upright food wares.

3. The food product stabilization system of claim 1, wherein at least one foundational base component is employed to provide additional substructure support for the at least one "L" shaped restraint article and any adjoining upright food wares.

4. The food product stabilization system of claim 3, wherein an enclosing cover is engaged and/or fastened upon the foundational base support thereby enabling a sealed containment system of the "L" shaped restraint article and any upright food wares.

5. The food product stabilization system of claim 4, wherein at least one carrying apparatus is disposed in a fastening relationship upon either the foundational base component or the enclosing cover thereby providing a convenient transportation system for the "L" shaped restraint article and any upright food wares.

6. The food product stabilization system of claim 1, wherein designed edges comprising proportionately designed curves, arcs, and/or straight segmented shapes are integrated into any periphery horizontal or vertical edge of the at least one "L" shaped restraint article.

7. The food product stabilization system of claim 1, further comprising a plurality of radial slots in the first horizontal base surface adapted to accommodate a bottom end of the hinge panel.

8. The food product stabilization system of claim 1, further comprising a plurality of vertically upright hinge panels having thru-holes.

9. The food product stabilization system of claim 1, each vertically upright hinge panel further comprising a thru-hole near a top of the hinge panel.

* * * * *